US005132496A

United States Patent [19]

Lee

[11] Patent Number: 5,132,496

[45] Date of Patent: Jul. 21, 1992

[54] MEMBRANE SWITCH

[75] Inventor: Keh-Houng Lee, Taipei, Taiwan

[73] Assignee: Acer Inc., Hsin Chu Science-Based Industrial Park, Taiwan

[21] Appl. No.: 681,014

[22] Filed: Apr. 5, 1991

Related U.S. Application Data

[63] Continuation of Ser. No. 375,798, Jul. 5, 1989, abandoned.

[51] Int. Cl.[5] ..... H01H 13/70

[52] U.S. Cl. ..... 200/5 A; 200/512; 200/288

[58] Field of Search ..... 200/5 A, 512–517, 200/317, 288

[56] References Cited

U.S. PATENT DOCUMENTS

| | | | |
|---|---|---|---|
| 3,617,660 | 11/1971 | Krakinowski | 200/512 X |
| 3,777,222 | 12/1973 | Harris | 200/5 A X |
| 4,046,975 | 9/1977 | Seeger, Jr. | 200/514 |
| 4,349,712 | 9/1982 | Michalski | 200/512 X |
| 4,375,585 | 3/1983 | Lee | 200/512 X |
| 4,485,279 | 11/1984 | Nakamura | 200/5 A |
| 4,503,294 | 3/1985 | Matsumaru | 200/5 A |
| 4,528,431 | 7/1985 | Coleman, III | 200/5 A X |
| 4,580,018 | 4/1986 | Yoshihara | 200/5 A |
| 4,596,905 | 6/1986 | Fowler | 200/5 A |
| 5,567,798 | 6/1984 | Iwai et al. | 200/514 |

FOREIGN PATENT DOCUMENTS

| | | |
|---|---|---|
| 0163149 | 4/1985 | European Pat. Off. . |
| 0202711 | 5/1986 | European Pat. Off. . |
| 0277404 | 2/1987 | European Pat. Off. . |
| 2013401 | 1/1979 | United Kingdom . |
| 2013402 | 1/1979 | United Kingdom . |

*Primary Examiner*—J. R. Scott

*Attorney, Agent, or Firm*—Robert C. Colwell; Greg T. Sueoka

[57] ABSTRACT

A membrane switch comprises an upper flexible layers, separation layer and a lower conductive layer mounted on a support. The membrane switch is designed to absorb the noise created when a key is depressed and an operating block collides with the layers directly beneath it. By creating several holes in the one or more of the lower layers of the membrane switch, and optionally the support that geometrically surrounds the aperture of the separation layer, the colliding force of the operating block on the laminated membrane switch is dispersed and much of the noise is absorbed.

4 Claims, 5 Drawing Sheets

MEMBRANE SWITCH

This is a continuation of application Ser. No. 07/375,798 filed Jul. 5, 1989 now abandoned.

BACKGROUND OF THE INVENTION

In conventional membrane switches, when a key operating block strikes the membrane, a great deal of the collision force is transformed into noise. An addition to this conventional design is implemented by IBM. The change in the conventional design is in the form of an extra layer of auxiliary flexible material (e.g., cloth, rubber, plastic, etc.) between the membrane and the supporting layer to absorb some of the force. Unfortunately, this increases the material cost and adds an unnecessary production expense.

SUMMARY OF THE INVENTION

The present invention relates to a membrane switch, and particularly to a keyboard membrane switch, comprising a membrane which has at least three layers, and a supporting layer beneath the membrane, with the addition of a plurality of holes located substantially below the said switch, for the absorption of the noise and the lessening of the impact created by the collision between the operating block and the base.

A primary purpose of the invention is to absorb the noise created when a key collides with a membrane, through a series of holes in the membrane levels and/or its supporting layer.

Another purpose of the invention is to decrease the additional material expenses by only requiring holes to be punched in the membrane layers and/or its supporting layer.

Other purposes and advantages will appear in the ensuing specification, drawings and claims.

BRIEF DESCRIPTION OF THE DRAWINGS

The invention is illustrated diagrammatically in the following drawings where.

DETAILED DESCRIPTION OF THE PREFERRED EMBODIMENTS

The present invention relates to a membrane switch in which the impact of the struck key is buffered and absorbed, utilizing a series of holes which act as shock and noise absorbers.

Figure 1A:
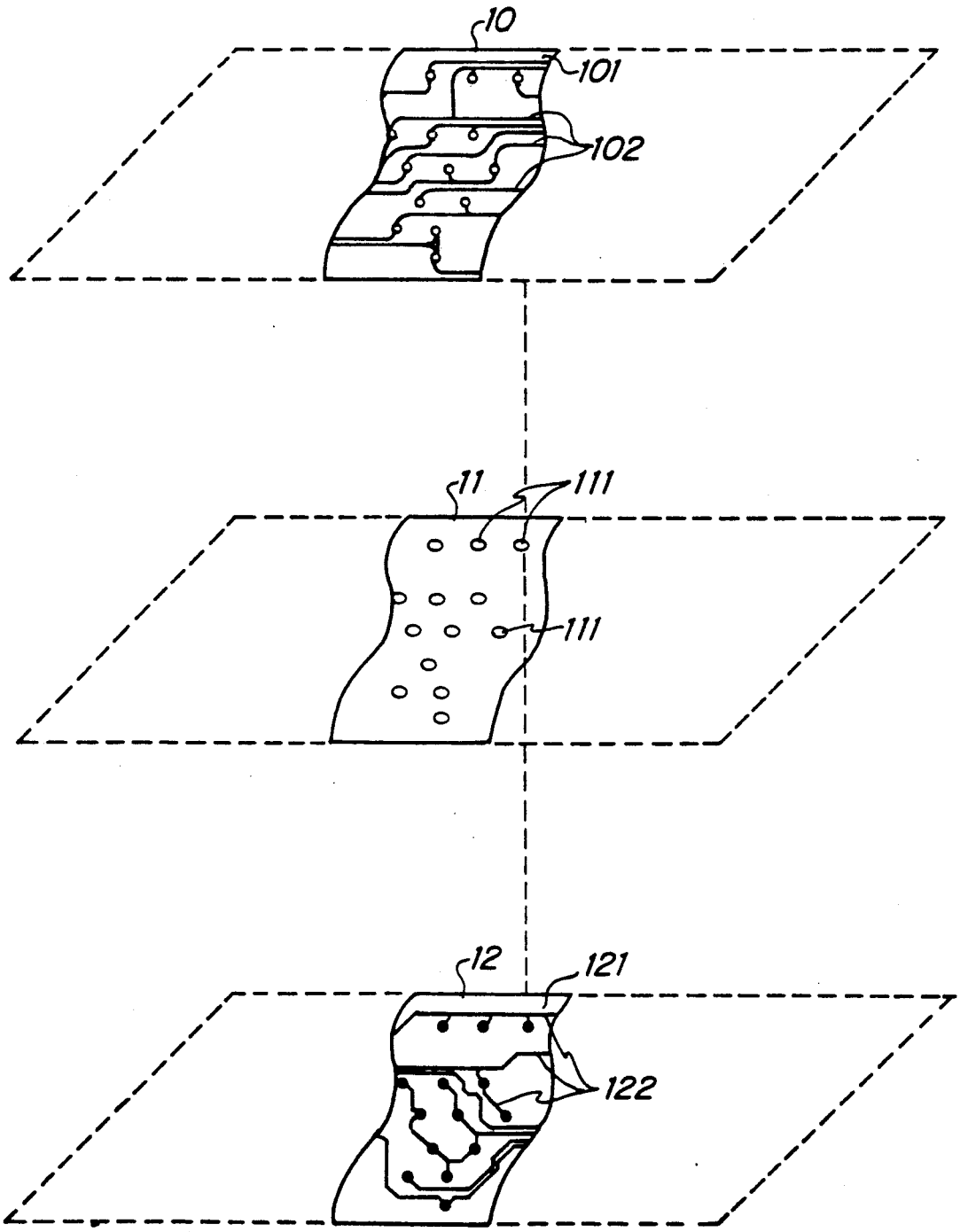
FIG. 1A shows an exploded cut-away view of three membrane layers of a conventional membrane switch.
Figure 1B:
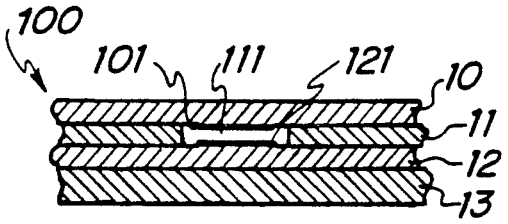
FIG. 1B shows a side view of the three membrane layers in FIG. 1A.
Figure 2A:
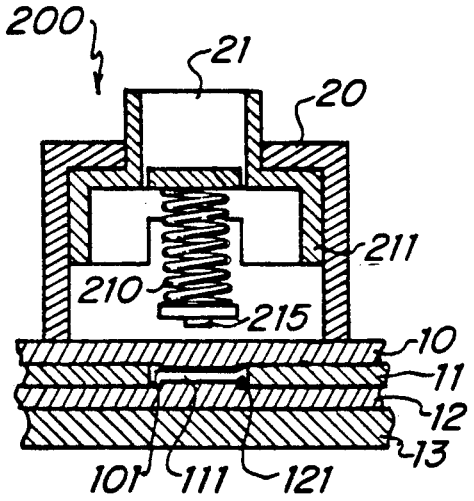
FIG. 2A illustrates the switch in FIG. 1B with an operating block of a single key in its OFF state.
Figure 2B:
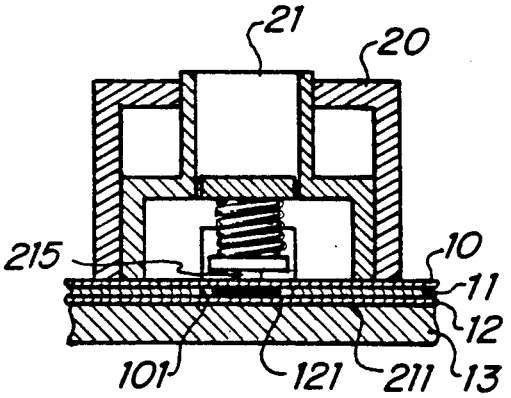
FIG. 2B illustrates the switch in FIG. 2A in its ON state.

In the conventional membrane switch, as shown in FIG. 1B, 2A and 2B, FIG. 1B is a cross-sectional side view of the three membrane layers (10, 11, 12) and their supporting layer (13). For explanation purposes, the thicknesses in FIG. 1B are exaggerated. In actuality, layers 10, 11 and 12 are thin, flexible and similar to that of photography film, as shown in FIG. 1A.

FIG. 1A, however, shows only a small portion of the entire membrane layers, but it is more accurately representative of the true thickness and configurations of the three membrane layers (10, 11, 12). The top layer 10 contains a series of silver contacts (101) and silver circuit lines (102) located underneath the surface; the middle layer 11 contains a series of holes (111) corresponding to the contacts; and the bottom layer 12 also contains a set of silver contacts (121) and silver circuit lines (122) substantially corresponding to those in layer 10.

In FIG. 1B the three membrane layers (10, 11, 12) are laminated together and placed on a supporting layer (13). Because layer 11 is sandwiched between layers 10 and 12, the silver contacts (101, 121) are separated by the hole (115) in layer 11, as shown in FIG. 1B. When the operating block (21) is pressed and the silver contacts (101, 121) are touched together (as shown in FIG. 2B), they complete the closed (ON) circuit and the computer receives the signal from the depressed key. When the key is released, the silver contacts return to their original (OFF) state.

FIG. 2A roughly represents conventional technology wherein the three membrane layers (10, 11, 12) are shown in Addition to the supporting layer (13), the operating block (21), the operating block's housing (20), the operating block's spring means (210), and the operating block's triggering element (215). This shows the switch in its OFF state. When the operating block is depressed, the triggering element (215) pushes the top membrane layer (10) down, allowing its silver contacts (101) to touch its corresponding silver contacts (121) on layer 12, as shown in FIG. 2B. FIG. 2B shows the ON state of FIG. 2A.

When the operating block is depressed, and the switch is turned ON, the bottom portion (220) of the operating block simultaneously strikes the membrane (100), causing additional noise—this is the drawback of conventional membrane switch technology. The present invention reduces this noise.

Figure 3:
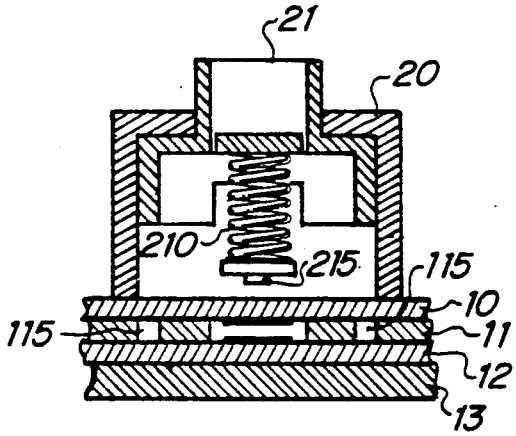
FIG. 3A shows an embodiment of a membrane switch according to the present invention wherein the auxiliary holes are located in the middle membrane layer.
FIG. 3B shows another embodiment of the membrane switch according to the present invention wherein the holes are located in the lower membrane layer.
FIG. 3C shows another embodiment of the membrane switch according to the present invention wherein there are holes present in the lower end middle membrane layers.
Figure 3A:
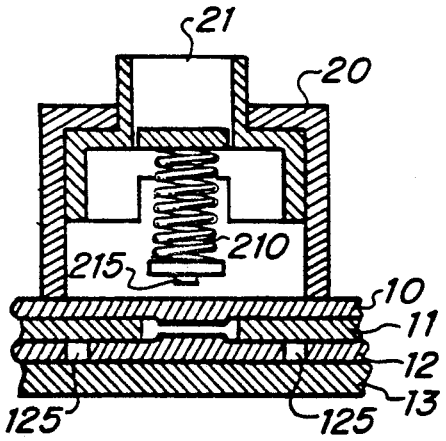

FIG. 3A shows one embodiment of the invention, in which holes (115) in layer 11 absorb much of the noise present when the operating block is depressed. Because the holes act as buffer gaps, the force of the collision is absorbed.

Figure 3B:
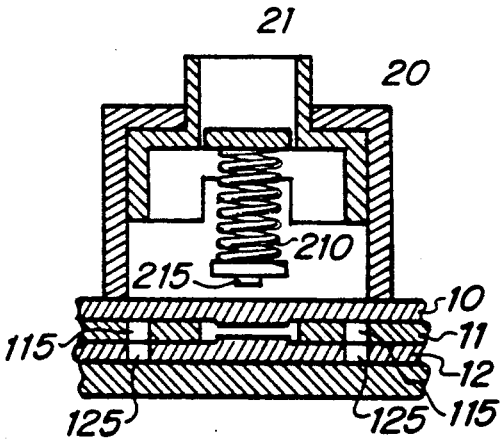

FIG. 3B is a variation of FIG. 3A wherein the hole is in layer 12, creating a silencing effect similar to that of FIG. 3.

FIG. 3C, another variation of the invention, has two layers of holes (115, 125) in membrane layers 11 and 12.

Figure 4:
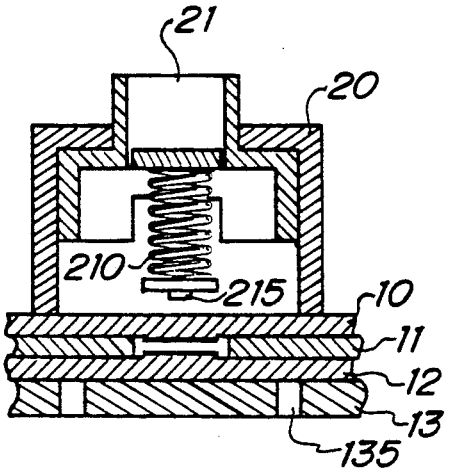
FIG. 4A shows another embodiment of the membrane switch according to the present invention wherein the holes are located in the support plate.
FIG. 4B shows another embodiment of the membrane switch according to the present invention wherein the holes are located in the lower membrane layer and the supporting plate.
FIG. 4C shows another embodiment of the invention wherein the holes are located in the middle and lower membrane layers and in the supporting plate.
Figure 4A:
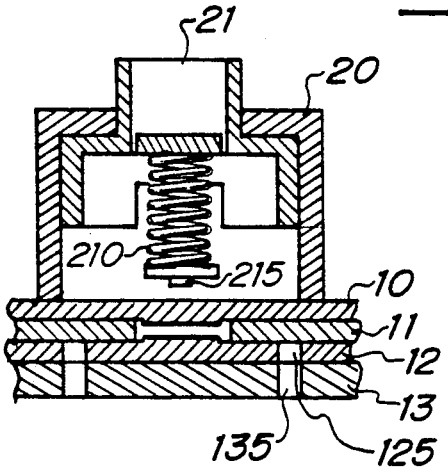

FIG. 4A shows another embodiment of the invention, in which the holes (135) are punched in the membrane supporting layer (13).

Figure 4B:
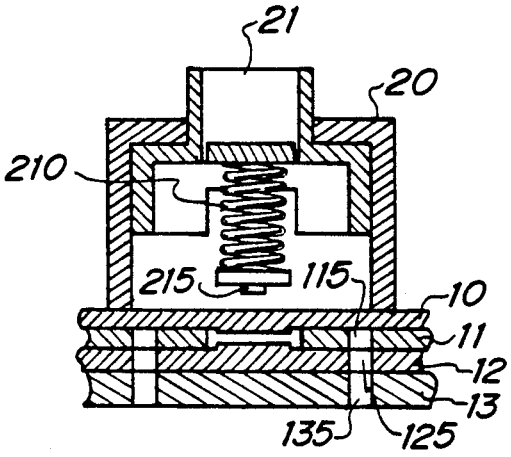

FIG. 4B shows two layers of holes, one (125) in membrane layer 12 and the other (135) in supporting layer 13.

FIG. 4C is a variation wherein there are holes (115, 125, 135) in layers 11, 12 and 13, respectively.

The preferred embodiment of the invention specifically used by the inventor is shown in FIG. 4A. As shown, the hole is designed to be created in the supporting layer of the keyboard.

Figure 5A:
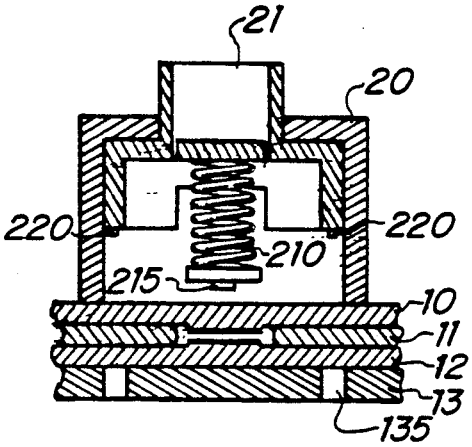
FIG. 5A shows another embodiment of the invention wherein the auxiliary projection points are added onto the bottom portion of the operating block.
Figure 5B:
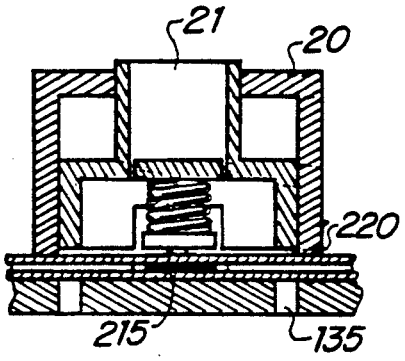
FIG. 5B shows another embodiment of the membrane switch of FIG. 5A in its ON state.

FIG. 5A includes auxiliary projection points (220) added onto the bottom portion of the operating block. These points correspond substantially to holes in the supporting layer. FIG. 5B shows FIG. 5A in its ON position. Thus, the goal of silencing the membrane switch is achieved to a great extent.

The principal advantage of the invention over the conventional design is that the improved membrane switch is substantially quieter and thus more pleasing to both the user and neighboring people in the vicinity who otherwise would be disturbed by the noise.

Another advantage is that the invention incurs no auxiliary material costs which would increase the production expense. The only modification required in the invention is the creation of holes in the membrane layers and/or the supporting layer.

Whereas the preferred form of the invention has been shown and described herein, it should be realized that there may be many modifications, substitutions and alterations thereto. The embodiments of the invention in which an exclusive property or privilege is claimed are defined as follows:

I claim:

1. A membrane switch assembly for use i a keyboard switch, said keyboard switch having a support member, a housing, and an operating block positioned in said housing and adapted for on-off switch control of said switch assembly, said operating block having a triggering element mounted to the operating block by a spring means, said membrane switch assembly having an upper contact carrying membrane and a lower contact carrying membrane spaced apart by a separation membrane having an aperture for allowing said upper contact carrying membrane to contact said lower contact carrying membrane when the said switch assembly is in the ON position, said lower contact carrying membrane mounted on said support member and said housing mounted on said upper contact carrying membrane, the triggering element of said operating block hitting upon the upper contact carrying membrane causing noise, wherein:

the separation membrane has a number of deformations each of which are located substantially under the triggering element of said operating block in positions distinct from the aperture, when the triggering element of operating block strikes a location of said upper contact carrying membrane while actuated, the location of said upper contact carrying membrane being struck is forced slightly into the deformations thereby absorbing the impact of the triggering element of said operating block on said upper contact carrying membrane during the operation of said keyboard switch.

2. The membrane switch assembly according to claim 1, wherein each deformation is in the form of a hole.

3. The membrane switch assembly according to claim 1, wherein each deformation is in the form of a cavity.

4. The membrane switch assembly according to claim 1, wherein the lower contact carrying membrane has a number of deformations each of which are located substantially under the deformations of the separation membrane.

* * * * *